US005477587A

United States Patent [19]

Glenn, III et al.

[11] Patent Number: 5,477,587

[45] **Date of Patent: * Dec. 26, 1995**

[54] VACUUM POWER HEAD WITH BARE FLOOR FEATURE

[75] Inventors: William K. Glenn, III; Donald W. Carnes; James F. Barnes, Jr., all of Anderson, S.C.

[73] Assignee: Ryobi Motor Products Corp., Easley, S.C.

[ * ] Notice: The portion of the term of this patent subsequent to Jun. 7, 2011, has been disclaimed.

[21] Appl. No.: 175,969

[22] Filed: Dec. 30, 1993

Related U.S. Application Data

[62] Division of Ser. No. 930,318, Aug. 10, 1992, Pat. No. 5,317,784.

[51] Int. Cl.[6] ..... A47L 5/34

[52] U.S. Cl. ..... 15/356; 15/365

[58] Field of Search ..... 15/355, 356, 364, 15/365, 366, 367, 373, 354

[56] References Cited

U.S. PATENT DOCUMENTS

| | | |
|---|---|---|
| 1,288,028 | 12/1918 | Kern . |
| 1,288,029 | 12/1918 | Kern . |
| 1,968,974 | 8/1934 | Tracy et al. . |
| 2,235,225 | 3/1941 | Ross . |
| 2,635,278 | 4/1953 | Belknap . |
| 2,651,803 | 9/1953 | Browne . |
| 2,842,792 | 7/1958 | Coons . |
| 2,850,757 | 9/1958 | Duff . |
| 2,938,225 | 5/1960 | Carabet . |
| 3,054,130 | 9/1962 | Ferrari . |
| 3,108,310 | 10/1963 | Allen et al. . |
| 3,768,114 | 10/1973 | Schwartz . |
| 4,014,068 | 3/1977 | Payne et al. . |
| 4,073,031 | 2/1978 | Schwartz . |
| 4,109,342 | 8/1978 | Vermillion . |
| 4,139,923 | 2/1979 | Rother . |
| 4,391,018 | 7/1983 | Vermillion et al. . |
| 4,446,595 | 5/1984 | Nakada et al. . |
| 4,573,237 | 3/1986 | Kochte et al. . |
| 4,638,526 | 1/1987 | Murata et al. . |
| 4,888,851 | 12/1989 | Crouser et al. . |
| 5,123,141 | 6/1992 | Erickson et al. . |
| 5,134,750 | 8/1992 | King et al. . |

FOREIGN PATENT DOCUMENTS

| | | |
|---|---|---|
| 1185346 | 1/1965 | Germany . |
| 0053742 | 1/1943 | Netherlands . |
| 0140024 | 8/1930 | Switzerland . |
| 0107172 | 6/1916 | United Kingdom . |

*Primary Examiner*—David Scherbel
*Assistant Examiner*—James F. Hook
*Attorney, Agent, or Firm*—Brooks & Kushman

[57] ABSTRACT

A vacuum power head is provided which has a bare floor feature. A vacuum cleaner head assembly defines a vacuum chamber which contains a power driven rotary brush. Located outside of the vacuum chamber adjacent the rotary brush is a generally U-shaped trailing brush. The trailing brush cooperates with a height adjustment mechanism which is movable between a deep carpet position and a bare floor position. As the height adjustment mechanism of the head assembly is moved toward the bare floor position, the trailing brush is automatically moved to an extended position into engagement with the floor. When the height adjustment mechanism is moved from the bare floor position, a biasing means biases the trailing brush toward a retracted position within the head assembly. An actuator cooperates with the height adjustment mechanism to automatically move the trailing brush between the retracted position and the extended position in response to movement of the height adjustment mechanism.

11 Claims, 4 Drawing Sheets

VACUUM POWER HEAD WITH BARE FLOOR FEATURE

This is a divisional of application Ser. No. 07/930,318 filed on Aug. 10, 1992 now U.S. Pat. No. 5,317,784.

TECHNICAL FIELD

This invention relates to vacuum cleaners and more particularly to upright vacuum cleaners having a retractable trailing brush for use on bare floors in the rear of the rotatable brush and the suction nozzle.

BACKGROUND ART

Traditionally, vacuum cleaners having power heads with a rotatable brush have been required to clean surfaces having both deep carpet and bare floors. Therefore it is necessary that this rotatable brush be capable of movement with the nozzle between various selected nozzle heights above the surface to be cleaned. For deep carpet surfaces, the nozzle is positioned at a high elevation relative to the surface to be cleaned and for bare floors, the nozzle is positioned at a low elevation relative the surface to be cleaned.

When cleaning bare floors the friction between the rotatable brush and the floor as a result the cleaning ability of the vacuum cleaner is diminished. The spacing of the base of the vacuum cleaner relative to the bare floor allows large particles of debris to be thrown backward by the rotatable brush at a speed which is too quick for the suction created by the nozzle to carry these particles into the nozzle.

Various attempts have been made to alleviate this problem. Initially, a flexible but fixed contact strip was utilized behind the rotatable brush to prevent the debris from travelling backward behind the nozzle. Examples of such an approach may be seen in U.S. Pat. Nos. 1,288,028 and 1,288,029.

Thereafter, a trailing brush was introduced which was movable between a retracted position within the head assembly and an extended position adjacent the bare floor. This approach utilizes various methods of extending and retracting the trailing brush. In all these approaches, the trailing brush is movable between the extended and retracted positions independent of the height of the head assembly. U.S. Pat. Nos. 4,014,068 to Payne et al., 4,073,031 to Schwartz, and 4,109,342 to Vermillion disclose approaches which rely on a foot or hand pedal to move the trailing brush between the retracted and extended positions.

The present invention is directed to improving known retractable trailing brush technology for use on bare floors by a vacuum cleaner. The present invention is directed to combining the operation of the height adjustment mechanism of a vacuum cleaner and the retractable trailing brush.

SUMMARY OF THE INVENTION

An object of the present invention is to provide a trailing brush which is movable between a retracted position adjacent the head assembly and an extended position adjacent the bare floor surface.

Another object of the present invention is to provide a trailing brush which cooperates with the height adjustment mechanism of an upright vacuum cleaner which automatically moves the trailing brush to an extended position when the height adjustment mechanism is moved to the bare floor position.

A feature of the present invention is to provide an actuator means for actuating the trailing brush when the height adjustment mechanism is set to the bare floor position.

An advantage of the present invention is to provide a trailing brush which stops debris which is thrown backward by the rotatable brush when the height of the head assembly is set to bare floor so that it may be forced into the nozzle by the suction created within the vacuum chamber.

A specific object of the present invention is to provide a vacuum cleaner having a head assembly which defines a vacuum chamber and includes a motor driven rotary brush located therein. A trailing brush is provided which is located within the head assembly. The trailing brush is movable between a retracted position within the head assembly and extended position adjacent a floor surface to be cleaned. A height adjustment mechanism is provided for varying the height of the rotary brush relative to the floor between a plurality of positions ranging from a deep carpet position to a bare floor position. An actuator means is also provided which cooperates with the height adjustment mechanism for actuating the trailing brush in conjunction with the height adjustment mechanism such that the trailing brush is automatically moved to the extended position in response to the height adjustment mechanism being moved to the bare floor position. The trailing brush is moved into the retracted position in response to movement of the height adjustment mechanism being moved away from the bare floor position.

Another specific object of the present invention is to provide a vacuum cleaner having a head assembly which defines a vacuum chamber which includes a motor driven rotary brush located therein. A trailing brush is provided which is located within the head assembly and which is movable between a retracted position within the head assembly and an extended position adjacent the floor surface to be cleaned. A height adjustment mechanism is provided which has a height adjustment member located within the head assembly. The height adjustment member has a plurality of settings corresponding to various heights ranging from a deep carpet position to a bare floor position. The height adjustment member is movable in a first direction in response to movement of the height adjustment mechanism between the deep carpet position and the bare floor position. An arm is provided which is located within the head assembly and cooperates with the height adjustment member. The arm is movable in a second direction generally perpendicular to the first direction in response to movement of the height adjustment member. An axle retainer is provided for retaining a plurality of wheels. The plurality of wheels are movable relative the head assembly in response to movement of the arm between the deep carpet position and the bare floor position. An actuator means is provided which cooperates with the height adjustment mechanism for actuating the trailing brush in conjunction with the height adjustment mechanism. The trailing brush is automatically moved to the extended position in response to the height adjustment mechanism being moved to the bare floor position and the trailing brush is moved to the retracted position in response to movement of the height adjustment mechanism being moved away from the bare floor position.

The above objects and other objects, features, and advantages of the present invention are readily apparent from the following detailed description of the best mode for carrying out the invention when taken in connection with the accompanying drawings.

DETAILED DESCRIPTION OF THE INVENTION

Figure 1:
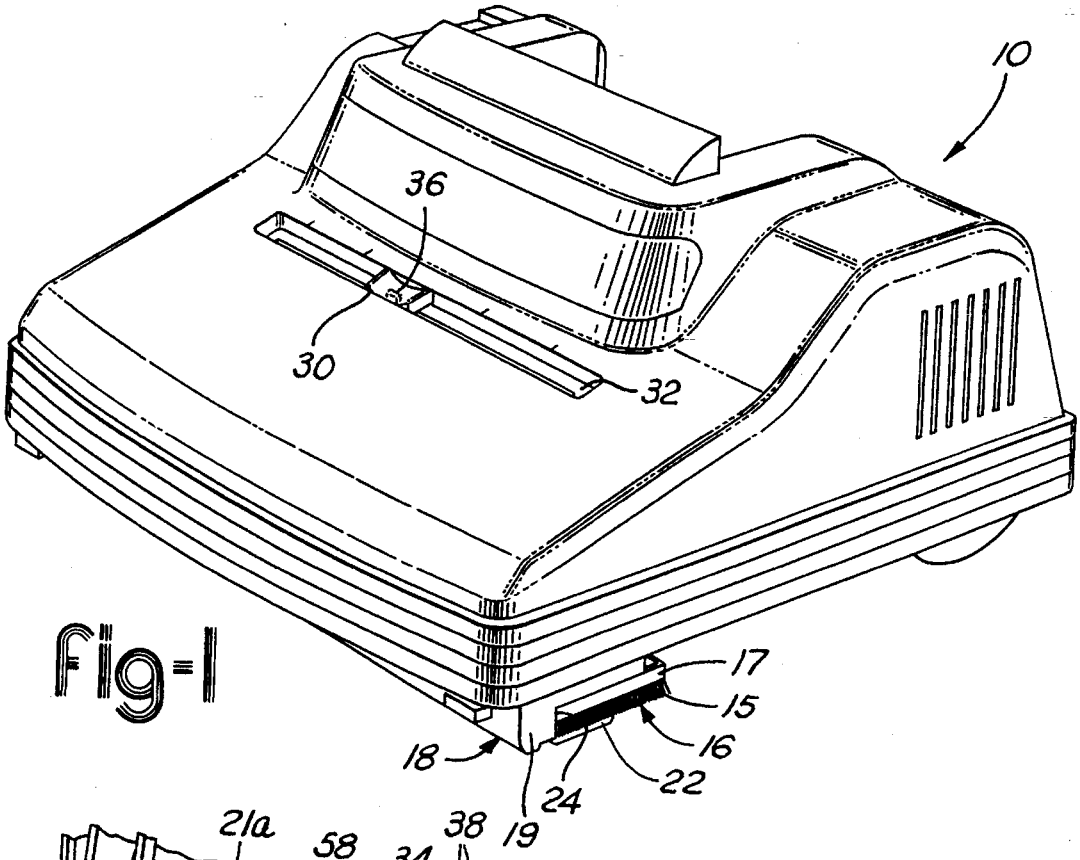
FIG. 1 is a perspective view of the head assembly showing the external elements of the present invention.
Figure 2:
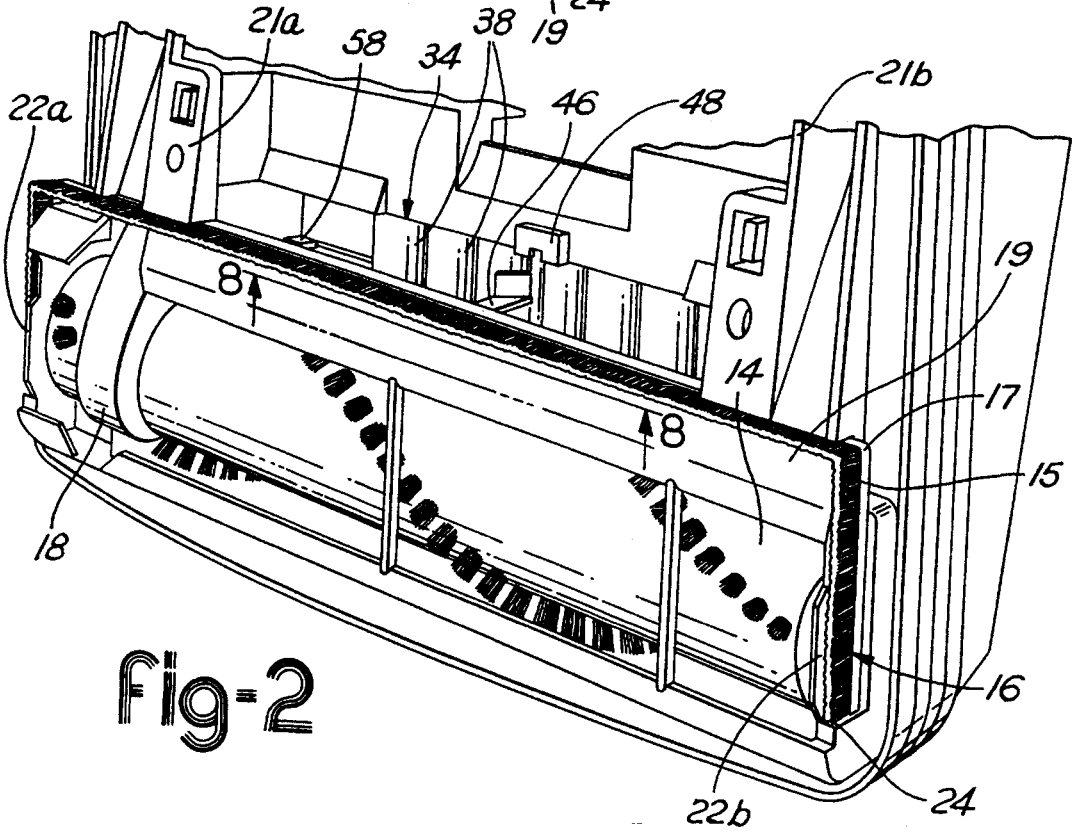
FIG. 2 is a bottom view in perspective of a portion of the head assembly showing internal elements in accordance with the present invention.

The preferred embodiment of the present invention is illustrated in FIGS. 1 through 9. As shown in FIGS. 1 and 2, a vacuum cleaner head assembly 10, defines a vacuum chamber 12 in the front portion of the head assembly 10. A rotary brush 14 is located within the vacuum chamber 12. An electric motor (not shown), drives the rotary brush 14 which agitates the surface to be cleaned.

Figure 3:
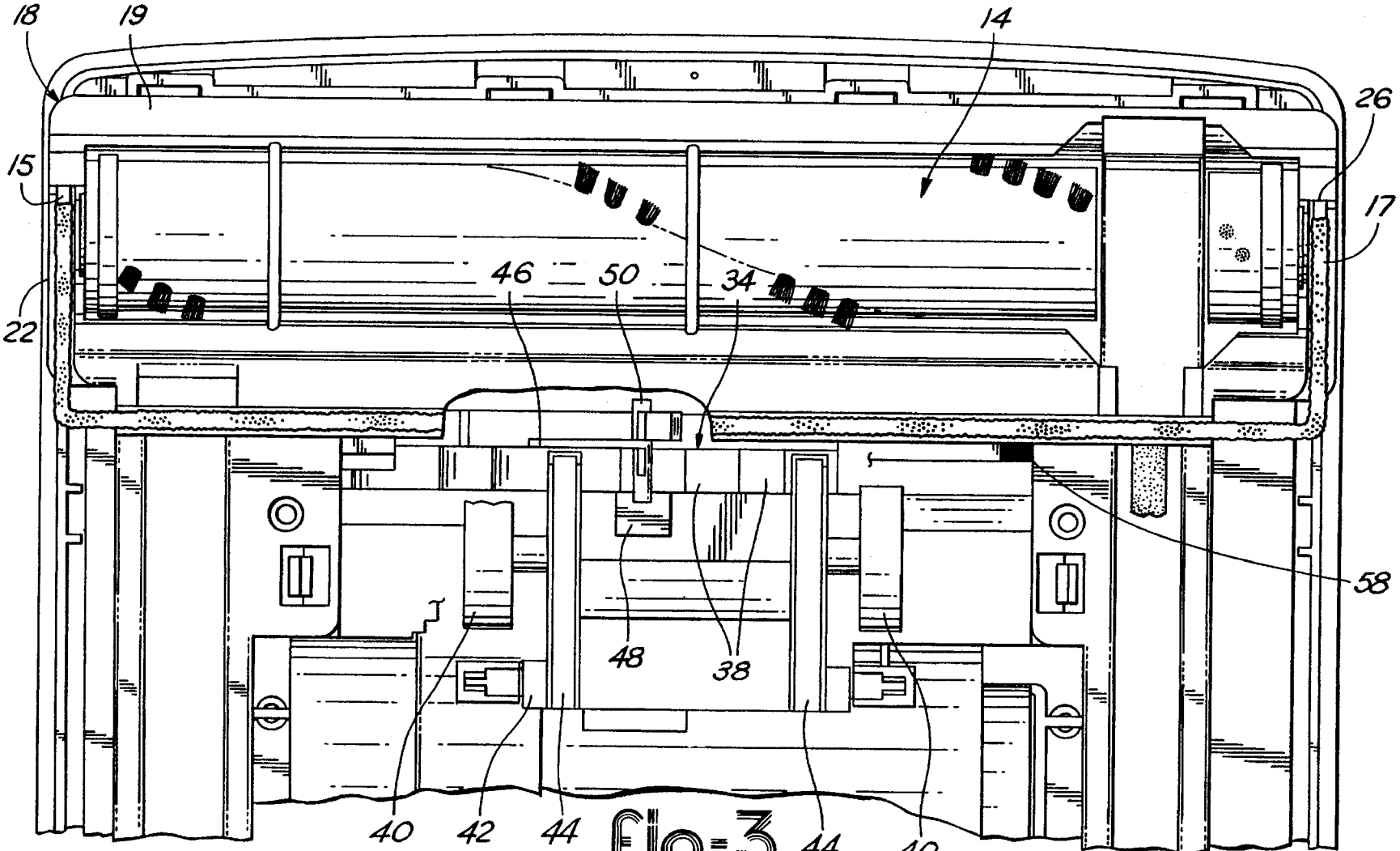
FIG. 3 is an enlarged bottom view of a portion of the head assembly showing the major elements in accordance wit present invention.
Figure 4:
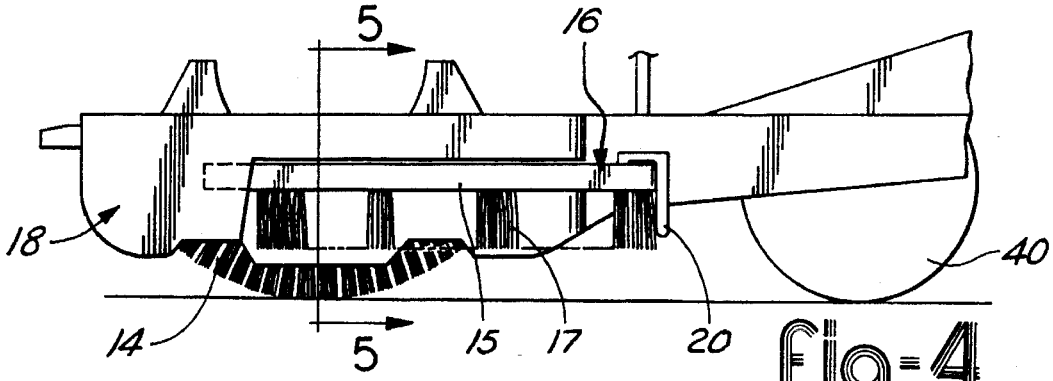
FIG. 4 is side view of a portion of the head assembly showing the trailing brush in relation to the rotatable brush and the front wheel.
Figure 5:
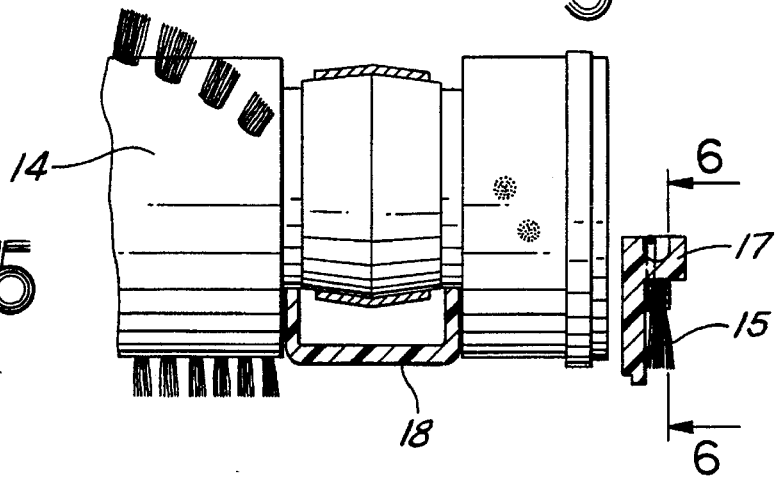
FIG. 5 is a cross-sectional view taken along the line 5—5 of FIG. 4.
Figure 6:
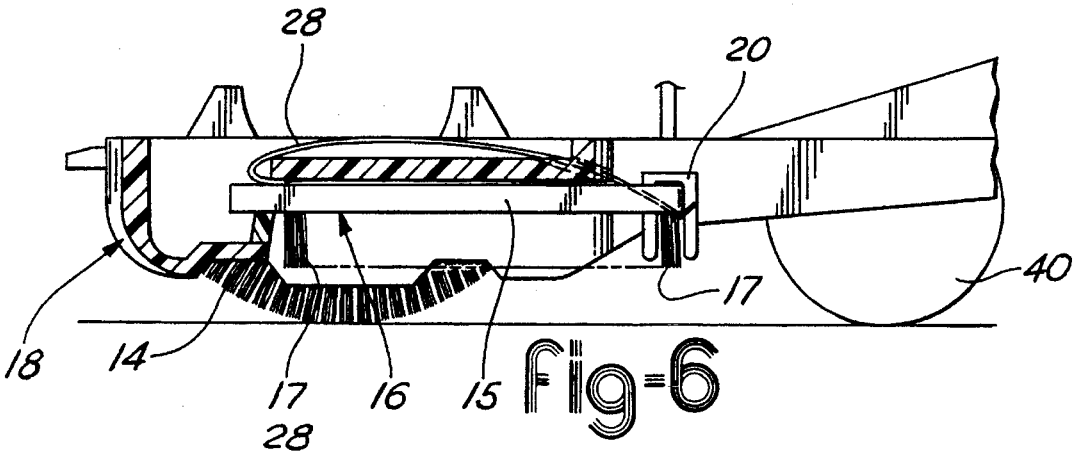
FIG. 6 is a cross-sectional side view taken along the line 6—6 of FIG. 5.
Figure 7:
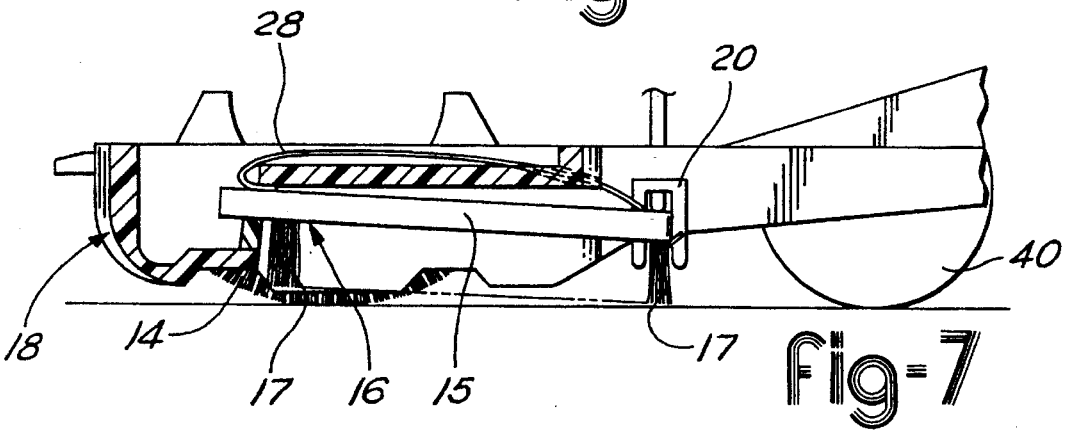
FIG. 7 a side view of a portion of the head assembly similar to that shown in FIG. 6, showing the trailing brush in extended position.

A trailing brush 16 is pivotally mounted behind the rotary brush 14 outside of the vacuum chamber 12. The trailing brush 16 is generally U-shaped (as shown in FIGS. 2, 3 and 5), such that the trailing brush 16 surrounds or borders the vacuum chamber 12. The trailing brush 16 is located behind and along both sides of the rotary brush 14 just outside of the vacuum chamber 12. The trailing brush 16 is formed of a generally U-shaped holding strip 15 which holds bristles 17 which form the trailing brush 16. The purpose of the trailing brush 16 is to engage the surface to be cleaned when the vacuum is set to the bare floor position. The positioning of the trailing brush 16 along the surface to be cleaned is to prevent large pieces of debris which, as shown in FIG. 7, are not initially drawn into the vacuum chamber 12 from traveling longitudinally along the floor beneath the vacuum cleaner. Instead, debris is caught in the trailing brush 16 until forced back into the vacuum chamber 12 by the suction created therein. The trailing brush 16 thereby improves the efficiency and cleaning power of the vacuum cleaner.

As shown in FIGS. 2 and 3, a retaining member 18 removably cooperates with the head assembly 10 to retain the rotary brush 14 and house the trailing brush 16. The retaining member 18 snap fits into the head assembly 10 ensuring that the rotary brush 14 is retained. The retaining member 18 has a generally rectangular body 19 which extends across the width of the head assembly 10. Two legs 21*a* and 21*b* extend rearwardly from the retaining member 18 toward the rear of the head assembly 10. Located between the body 19 and the legs 21*a* and 21*b* is a channel 20. Cutouts 22*a* and 22*b* are located along the sides of the body 19 which sufficiently reduces the width of the body 19 to accommodate the trailing brush 16. The cutouts 22*a* and 22*b* extend to a location toward the front of the body 19. The body 19 then attains its original width, forming a shoulder 24.

The U-shaped trailing brush 16 shown in FIGS. 2 and 3, has two free ends, each of which is inserted into an aperture 26 located in each shoulder 24. A pair of springs 28*a* and 28*b* are affixed at one end to the free ends of the trailing brush 16 to secure it into position. The other end of each spring 28*a*, 28*b* is secured to the body 19 at cutouts 22*a* and 22*b*. The attachment of each spring 28*a* and 28*b* in this fashion biases the trailing brush 16 toward a retracted position, shown in FIGS. 2,4 and 6, wherein the trailing brush 16 is seated within the channel 20.

Figure 10:
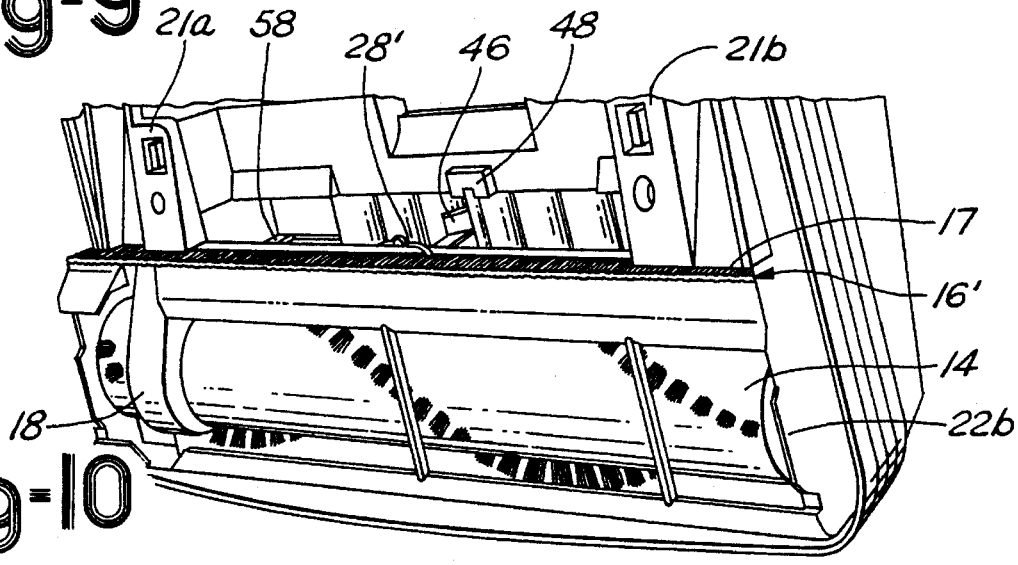
FIG. 10 is an alternate embodiment of the head assembly having a straight trailing brush.

An alternative embodiment of a trailing brush is shown in FIG. 10. In this embodiment, the trailing brush 16' is straight, rather than having a U-shaped configuration surrounding the vacuum chamber 12. The trailing brush 16' functions in a similar manner as in the embodiment shown in FIGS. 2, 3 and 5. Spring 28' is located centrally on the retaining member 18 and biases the trailing brush 16' to the retracted position. By locating the spring 28' adjacent to the centrally located lever 46 flexing of the trailing brush 16' can be minimized.

A height adjustment mechanism is formed by a combination of elements described in the following two paragraphs. A height adjustment knob 30 is located on the upper external surface of the head assembly 10 as shown in FIG. 1. The height adjustment knob 30 fits within a groove 32 located within the upper external surface of the head assembly 10. The knob 30 cooperates with a slide 34, located within the head assembly 10. The knob 30 is seated upon a protrusion 36 integrally formed with the slide 34. As shown in FIGS. 2, 3, 8 and 9, the underside of the slide 34 has a series of stair step detents 38. The detents 38 vary in height corresponding to varying height positions of a front pair wheels 40. An axle retainer assembly 42 is mounted to the head assembly 10. The assembly 42 has a pair of arms 44 which cooperate with detents 38 allowing the wheels 40 to pivot. The wheels 40, the arms 44, the detents 38 and the knob 30 cooperate to vary the height of the head assembly 10 between a bare floor position (shown in FIG. 7) and a deep carpet position (shown in FIG. 4).

As shown in FIGS. 2, 3, 8 and 9, a lever 46 is pivotally connected to the head assembly 10 by a retainer member 48 and a notch 50 located on opposite sides of the lever 46. The retainer member 48 is affixed to the head assembly 10 by means such as gluing. A retaining spring 52 has one end affixed to the head assembly 10 and the other end is affixed to the lever 46, adjacent the notch 50, to prevent the lever 46*b* from becoming disengaged with the notch 50.

Figure 8:
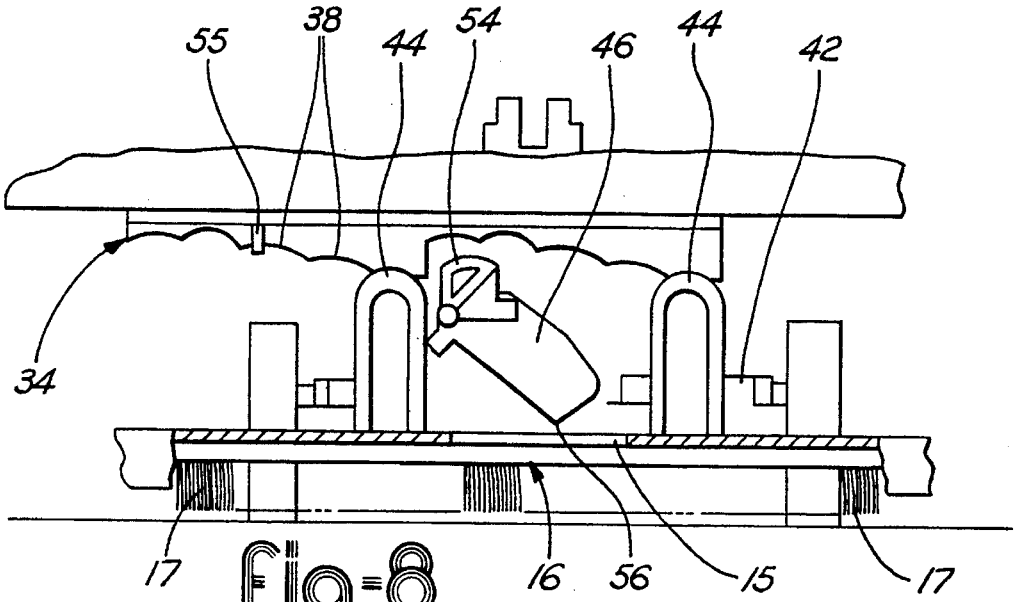
FIG. 8 is a cross-sectional end view of the internal portion of the head assembly showing a lever initiating contact with the trailing brush in accordance with the present invention.
Figure 9:
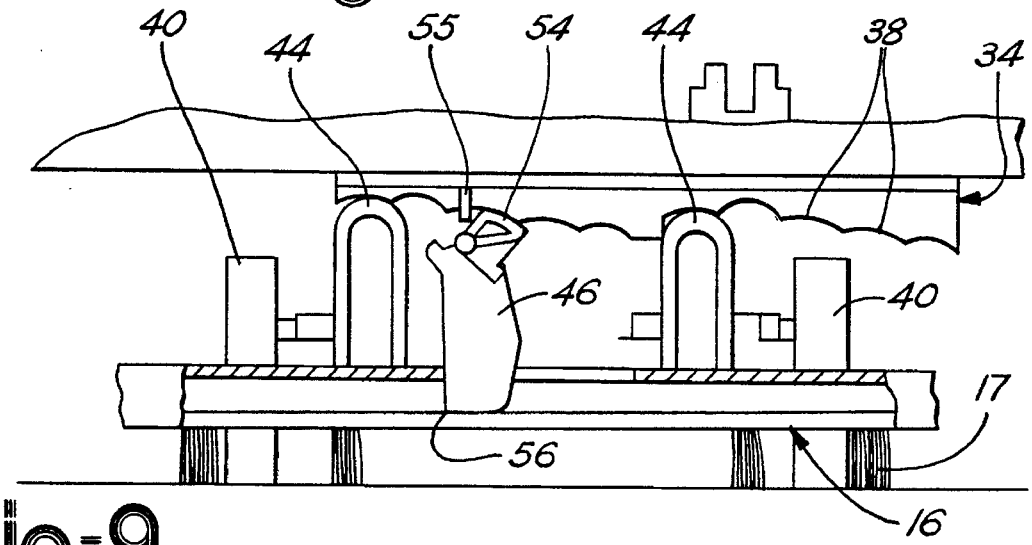
FIG. 9 is a view similar to that shown in FIG. 8 showing the upper surface of the lever overcoming the bias of the springs moving the trailing brush to the extended position.

As shown in FIGS. 8 and 9, the lever 46 pivots about an axis which is generally perpendicular to the longitudinal direction of travel of the slide 34. The lever 46 has a generally U-shaped bottom surface 54 which is engaged by a projection 55 on the slide 34 as the slide 34 moves toward the bare floor position. The projection 55 engages the bottom surface 54 causing the lever 46 to pivot about its axis. As the lever 46 pivots about its axis, a cammed upper surface 56 engages the holding strip 15 of the trailing brush 16. As the slide 34 continues to travel toward the bare floor position, the projection 55 continues to engage the bottom surface 54. This continued engagement by the projection 55 causes the lever 46 to continue to pivot, resulting in the upper surface 56 overcoming the bias of the springs 28*a* and 28*b* (spring 28*a* shown in FIG. 7). Once the lever 46 has overcome the bias of the springs 28*a* and 28*b*, the lever urges the trailing brush 16 to the extended position in contact with the bare floor. The slide 34 continues to travel toward the bare floor position while the arms 44 travel within the detent 38 which corresponds to the bare floor position until the slide 34 contacts a stop 58 (shown in FIGS. 2 and 3) affixed to the head assembly 10. This combination of the lever 46, the slide 34 and the projection 55 provide a means for actuating the trailing brush 16. It is understood that alternative elements may be utilized while still obtaining the same results of actuating the trailing brush 16.

As shown in FIGS. 8 and 9, as the slide 34 moves in a first direction, generally longitudinally, between the deep carpet position and the bare floor position, the arms 44 move in a second direction generally perpendicular to the first direction. The arms 44 travel over the detents 38 as the slide 34 moves along between positions. The height of the detents 38 get progressively higher along the direction of movement of the slide 34 toward the bare floor position until the second last detent 38. This is the position where the trailing brush 16 and the rotary brush 14 are simultaneously at their lowest position for cleaning very short fiber carpets. The last detent 38 (the bare floor position) is slightly lower than this highest position. In the bare floor position, it is desirable for only the trailing brush 16 to be in contact with the surface and to have the rotary brush 14 raised slightly above the surface to avoid having the rotary brush 14 beating against the bare floor potentially damaging the rotary brush 14 and/or the bare floor.

As the knob 30 is moved away from the bare floor position toward the deep carpet position, the springs 28*a* and 28*b* bias the trailing brush 16 back to the retracted position. This is accomplished by having the upper surface 56 cam away from and release contact with the trailing brush 16.

While the best mode for carrying out the invention has been described in detail, those familiar with the art to which this invention relates will recognize various alternative designs and embodiments for practicing the invention as defined by the following claims.

What is claimed is:

1. A vacuum cleaner for use by a user to clean a floor surface, the vacuum cleaner comprising:

a head assembly having an elongate vacuum chamber;

a motor driven generally cylindrical elongate rotary brush rotatably supported within the vacuum chamber;

a trailing brush located within the head assembly rearward of the rotary brush, the trailing brush being selectively positionable between a retracted position wherein the trailing brush is located away from a floor surface and an extended position wherein the trailing brush is located adjacent the floor surface;

a first height adjustment mechanism for varying the height of the rotary brush relative to the floor between a plurality of height positions including a highest position and a bare floor cleaning position;

a second height adjustment mechanism for selectively positioning the trailing brush between the retracted position and the extended position; and a single control knob which is selectively movable relative to the head assembly to actuate the first height adjustment mechanism to place the rotary brush in the bare floor cleaning position and concurrently actuate the second height adjustment mechanism to place the trailing brush in the extended position and to move the rotary brush out of the bare floor cleaning position and concurrently place the trailing brush in the retracted position.

2. The vacuum cleaner of claim 1 wherein:

the first and second height adjustment mechanisms are engageable with one another so that the rotary brush and trailing brush are concurrently and selectively positionable in the respective bare floor cleaning and extended positions.

3. The vacuum cleaner of claim 1 wherein:

the first height adjustment mechanism includes an axle retainer retaining a plurality of floor engaging wheels and includes a slide having a plurality of varying height spaced apart detents, the slide being translatable with respect to the head assembly with the plurality of detents thereon selectively cooperating with the axle retainer and head assembly to vary the height of the head assembly and rotary brush with respect to the floor between the bare floor cleaning position and the highest position; and the slide being engageable with the second height adjustment mechanism to selectively position the trailing brush between its retracted and extended positions.

4. The vacuum cleaner of claim 1 wherein:

the second height adjustment mechanism includes a cam pivotally connected relative to the housing; and the slide is translatable to engage and disengage the cam to thereby control the movement of the trailing brush between its extended and retracted positions.

5. The vacuum cleaner of claim 1 further comprising:

a spring biasing the trailing brush into its retracted position;

wherein the engagement of the cam with the slide causes the cam to overcome the bias of the spring and place the trailing brush in its extended position.

6. A vacuum cleaner comprising a head assembly having an elongate vacuum chamber extending the width thereof and including a motor driven cylindrical rotary brush located therein and extending substantially the full width of said vacuum chamber, said vacuum cleaner further comprising:

a trailing brush located within said head assembly adjacent said vacuum chamber, at least a transversely extending main portion of said brush being positioned to the rear of said vacuum chamber and extending in generally parallel alignment with said rotary brush for the full length thereof, said trailing brush being movable between a retracted position within the head assembly and an extended position adjacent a floor surface to be cleaned;

a height adjustment mechanism for varying the height of said rotary brush relative to the floor between a plurality height positions ranging from a deep carpet position to a bare floor position;

said height adjustment mechanism including (i) an axle retainer assembly having a plurality of floor engaging wheels, said axle retainer assembly being pivotally carried on said head assembly and thereby cooperating with said head assembly for effectively varying the height of said rotary brush relative to the floor, and (ii) a slide located within said head assembly, said slide being movably adjustable to any one of said plurality of height positions ranging serially in ascending order between the bare floor position and the deep carpet position, and cooperating with said axle retainer assembly to raise or lower the head assembly and thus the rotating brush relative to the axle retainer assembly and floor to any one of said range of height positions; and actuator means operatively coupled with said height adjustment mechanism for selectively and automatically actuating said trailing brush in conjunction with said height adjustment mechanism, wherein said trailing brush is automatically moved to said extended position in response to said height adjustment mechanism being moved to the bare floor position and wherein said trailing brush is moved to said retracted position in response to movement of said height adjustment mechanism away from said bare floor position.

7. A vacuum cleaner in accordance with claim 6 wherein said actuator means comprises:

a projection located on said slide and movable therewith;

a lever having first and second free ends, the lever located within and pivotally affixed intermediate its free ends to said head assembly, one free end of said lever being of sufficient length to engage said trailing brush approximately intermediate the main portion thereof as said projection engages and rotates the other free end about the pivot axis of said lever to thereby move said trailing brush alternatively between said extended position and said retracted position; and a spring located between said trailing brush and said head assembly for urging said trailing brush to said retracted position.

8. A vacuum cleaner in accordance with claim 6 wherein said actuator means includes a spring interposed between said head assembly and said trailing brush, such that said spring biases said trailing brush toward said retracted position.

9. A vacuum cleaner in accordance with claim 6 wherein said slide includes a series of stair step detents varying in height and corresponding to a respective one of said plurality of height positions, said slide being supported on said axle retainer assembly whereby as the slide is reciprocated, the head assembly pivots about said axle retainer assembly to the height position selected.

10. A vacuum cleaner in accordance with claim 6 wherein said trailing brush has a generally U-shaped configuration whereby the brush extends from the distal ends of said main portion of the brush along the sides of said vacuum chamber to further entrap dirt or other particulates within the region of the vacuum chamber.

11. A vacuum cleaner in accordance with claim 10 wherein said trailing brush includes a U-shaped holding strip having bristles extending thereupon, the distal ends of siad holding strip being supported on said head assembly and defining a pivot axis about which said brush may pivot from the extended position to the spring urged, fully retracted position.

* * * * *

UNITED STATES PATENT AND TRADEMARK OFFICE

CERTIFICATE OF CORRECTION

PATENT NO. : 5,477,587

DATED : December 26, 1995

INVENTOR(S) : William K. Glenn III et al.

It is certified that error appears in the above-indentified patent and that said Letters Patent is hereby corrected as shown below:

Column 6, line 54, claim 6, after "plurality, and before "height", insert --of--;

Column 8, line 22, claim 8, "siad" (first occurrence) should be --said--.

Signed and Sealed this

Seventh Day of May, 1996

Bruce Lehman

*Attest:*

BRUCE LEHMAN

*Attesting Officer*

*Commissioner of Patents and Trademarks*